US009743791B2

(12) United States Patent
Haynesworth

(10) Patent No.: US 9,743,791 B2
(45) Date of Patent: Aug. 29, 2017

(54) EASY TOOLESS INSTALLED CURTAIN ROD FOR WINDOW

(71) Applicant: Noris Haynesworth, Newport News, VA (US)

(72) Inventor: Noris Haynesworth, Newport News, VA (US)

( * ) Notice: Subject to any disclaimer, the term of this patent is extended or adjusted under 35 U.S.C. 154(b) by 0 days.

(21) Appl. No.: 14/588,927

(22) Filed: Jan. 3, 2015

(65) Prior Publication Data

US 2016/0192800 A1 Jul. 7, 2016

(51) Int. Cl.

*A47H 1/102* (2006.01)
*A47H 1/08* (2006.01)
*A47H 1/022* (2006.01)

(52) U.S. Cl.

CPC ..... *A47H 1/102* (2013.01); *A47H 1/022* (2013.01); *A47H 1/08* (2013.01)

(58) Field of Classification Search

CPC . A47H 1/02; A47H 1/102; A47H 1/12; A47H 1/122; A47H 1/124; A47H 1/14; A47H 1/142; A47H 1/144; A47H 1/18; B60P 7/14; B60P 7/15

USPC ..... 211/105.1–105.6; 248/200.1

See application file for complete search history.

(56) References Cited

U.S. PATENT DOCUMENTS 1,548,053 A * 8/1925 Mead ..... A47H 1/022 248/200.1
2,253,664 A * 8/1941 Vigo ..... A47K 10/22 211/105.6
2,973,870 A * 3/1961 Schoos ..... A47H 1/022 211/105.6
2,974,931 A * 3/1961 Reel ..... B60P 7/15 248/354.1
4,118,087 A * 10/1978 Dorf ..... A47B 45/00 211/105.6
4,147,199 A * 4/1979 Cameron ..... A47H 1/102 160/330
4,343,578 A * 8/1982 Barnes ..... B60P 7/15 410/143
4,492,263 A * 1/1985 Gebhard ..... E06B 9/02 160/222
5,799,346 A * 9/1998 Tiernan ..... E03C 1/06 211/105.6

(Continued)

*Primary Examiner* — Korie H Chan

(74) *Attorney, Agent, or Firm* — Thien Tran, Esq; Access Patent Group, LLC.

(57) ABSTRACT

An easy tooless installed curtain rod for window, includes an elongated tubular member having a hollow chamber at an inner end. A coil spring is placed within the hollow chamber of the elongated tubular member. A short tubular sleeve slides over the inner end of the elongated tubular member to engage with the coil spring. A pair of round metal stoppers is provided. The first stopper fits onto a distal end of the elongated tubular member and the second stopper fits onto a distal end of the short tubular sleeve. A curved handle is affixed onto a side of the short tubular sleeve. When the curved handle is manually pulled or twisted inwardly, the short tubular sleeve will compress the coil spring to provide tension and flexibility between the pair of round metal stoppers which can be positioned to bear against opposite side walls of a window, so that a curtain can hang on the elongated tubular member that is secured within the window.

14 Claims, 2 Drawing Sheets

(56) References Cited

U.S. PATENT DOCUMENTS

| | | | | |
|---|---|---|---|---|
| 8,056,873 | B1 * | 11/2011 | Hanley | A47H 1/022<br>248/261 |
| 8,925,747 | B1 * | 1/2015 | Hanley | A47H 1/022<br>211/105.6 |
| 9,339,901 | B2 * | 5/2016 | Miller | B23P 19/04 |
| 2009/0101609 | A1 * | 4/2009 | Batshon | A47H 1/122<br>211/105.3 |

* cited by examiner

EASY TOOLESS INSTALLED CURTAIN ROD FOR WINDOW

CROSS-REFERENCE TO RELATED APPLICATION

This application claims the benefit of Provisional Patent Application No. 61/923,273, filed on Jan. 03, 2014, In the United States Patent & Trademark Office, the disclosure of which is incorporated herein by reference.

BACKGROUND OF THE INVENTION

Field of the Invention:

The present invention relates to window curtains, and more particularly, an easy tooless installed curtain rod for different sizes of the windows.

When hanging curtain rods, property owners or renters generally are forced to drill holes into the walls. For those who are renting, this may be problematic. For those who own their own homes, this method can create an unattractive appearance in the home. Additionally, it is a tedious task to restart the curtain hanging process when people move from one property to the next.

The present invention describes a simplified process for hanging curtains. The invention eliminates the damage incurred by mounting a curtain rod onto a wall. The invention enables property owners and renters to hang curtain rods without using tools or tooless.

Description of the Prior Art:

Numerous innovations for curtain rods have been provided in the prior art that will be described. Even though these innovations may be suitable for the specific individual purposes to which they address, however, they differ from the present invention.

A FIRST EXAMPLE, U.S. Patent Office Publication No. 2003/0056908, Published on Mar. 27, 2003, to Samelson teaches a cover that mounts over the end of a tension rod of the type which is used to mount window curtains or the like between opposing surfaces of a window recess. The cover is provided in mating parts which are assembled and joined together. The edges of the parts are provided with aligned pairs of protrusions and recesses adapted to frictionally engage to join the parts. Some of the protrusions are bifurcated with a circumferential flange for more positive engagement. To make the cover compatible with a smaller diameter rod, a split ring adapter collar can be situated between the rod and the neck of the cover.

A SECOND EXAMPLE, U.S. Patent Office Publication No.2007/0056700, Published on Mar. 15, 2007, to Hemmady teaches a method or technique to easily and quickly install curtain rods and window shades without drilling holes in walls, door or window sills to attach/install and detach/remove brackets. The invention has come up with a unique use of an existing product developed by 3M.TM. Company that is currently used for hanging picture frames and other items that are hung on room/bathroom walls, doors etc. The invention has come up with a technique that attaches this unique sticky material to specially designed end/center brackets that are used to hang curtain rods or window shades. It has the unique advantage of an easy install without making invasive drilled holes in walls, door/window sills that are currently used to attach these brackets using some kind of fastener. It also provides the unique advantage of easy removal of these brackets (and curtain rods/shades) without causing any damage to the surface on which these brackets are installed.

A THIRD EXAMPLE, U.S. Patent Office Publication No. 2008/0245940, Published on Oct. 09, 2008, to Brown teaches an adjustable mounting system for use with a variety of window treatments comprises a head rail, an adjustable support rod, and one or more clips for coupling the support rod to the head rail. The mounting system is preferably non-invasive and does not damage window casings. The mounting system may be installed very quickly and easily, without the need for any tools. The head rail is adapted for use with a wide variety of window treatment assemblies.

A FOURTH EXAMPLE, U.S. Patent Office Publication No. 2012/0241399, Published on Sep. 27, 2012, to Trettin et al. teach an adjustable curtain rod assembly that includes a rod member and an adjustment mechanism coupled to an end of the rod member. The adjustment mechanism is operable to adjust a length of the rod assembly and has a clutch mechanism that prevents over-extension of the rod assembly during mounting.

A FIFTH EXAMPLE, U.S. Patent Office Publication No. 2014/0131299, Published on May 15, 2014, to Didehvar et al. teaches an adjustable rod assembly which includes first and second tubes having first and second arcuate portions, third and fourth tubes of generally straight configurations, first and second end supports, and a tension rod mechanism secured within the third tube. The first tube has a first end, a second opposing end, and a planar surface extending from the second end toward the first end. The first tube is telescopingly received within the third tube and the second tube. The third tube is rotatable relative to the first tube and is rotatably secured within the fourth tube. The fourth tube is secured to the first end support and the second tube is secured to the second end support. The tension rod mechanism rotates with the third tube and has a threaded portion configured to extend from an interior of the third tube to an interior of the first tube.

It is apparent now that numerous innovations for curtain rods have been provided in the prior art that are adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide an easy tooless installed curtain rod that avoids the disadvantages of the prior art.

ANOTHER OBJECT of the present invention is to provide an easy tooless installed curtain rod that is simple and inexpensive to manufacture.

STILL ANOTHER OBJECT of the present invention is to provide an easy tooless installed curtain rod that is simple to use.

BRIEFLY STATED, STILL YET ANOTHER OBJECT of the present invention is to provide an easy tooless installed curtain rod comprising an elongated tubular member having a hollow chamber at an inner end. A metal coil spring is placed within the hollow chamber of the elongated tubular member. A short tubular sleeve slides over the inner end of the elongated tubular member to engage with the metal coil spring. A pair of round metal stoppers is provided. The first stopper fits onto a distal end of the elongated tubular member and the second stopper fits onto a distal end of the short tubular sleeve. A curved handle is affixed onto a side of the short tubular sleeve. When the curved handle is manually pulled or twisted inwardly, the short tubular sleeve will compress the metal coil spring to provide tension and flexibility between the pair of metal stoppers (with non-skid rubber material end pieces) which can be positioned to bear against opposite side walls of a window, so that a curtain can hang on the elongated tubular member that is secured within the window. A pair of double ring components and other attachments make this curtain rod exceptional different than other existing products in the market.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawings are briefly described as follows.

REFERENCE NUMERALS UTILIZED IN THE DRAWING

Figure 1:
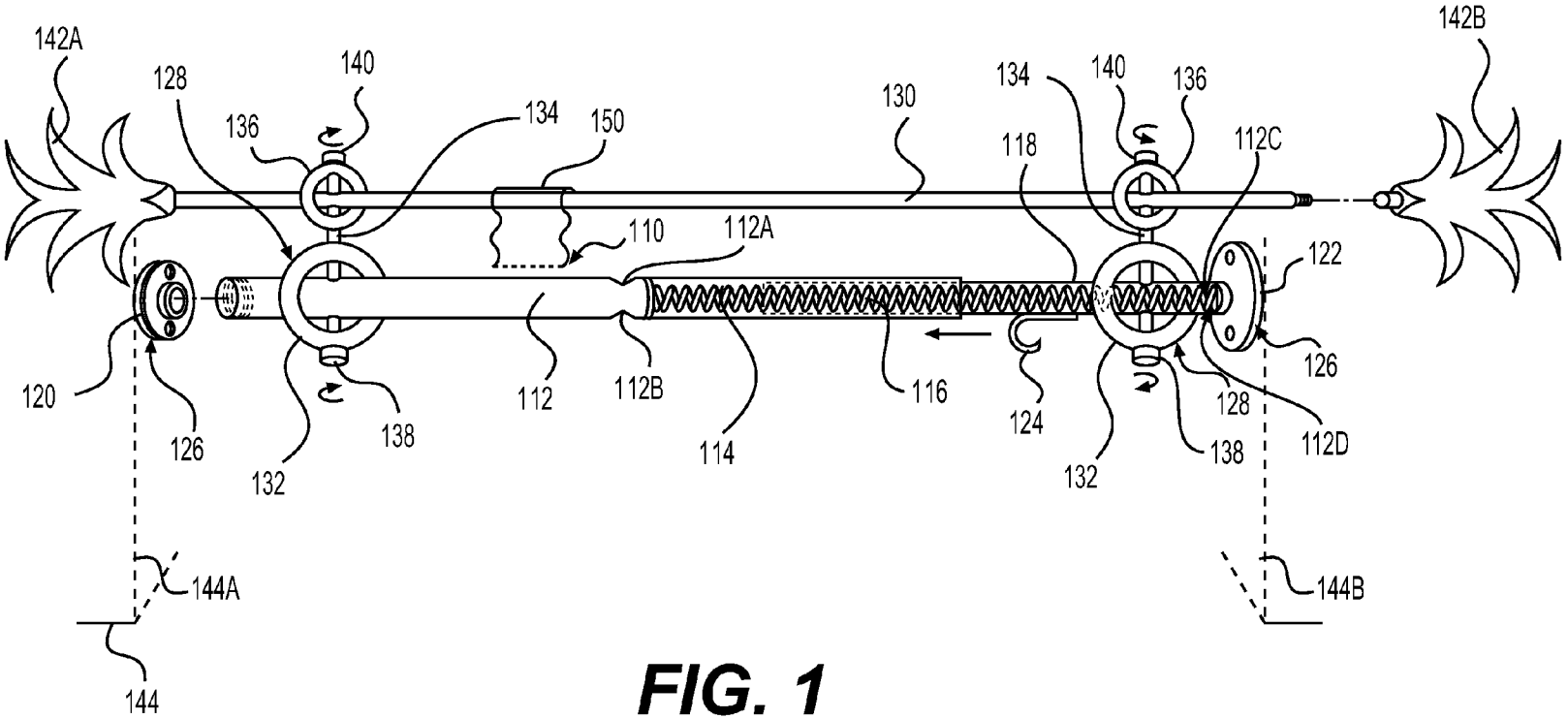
FIG. 1 is a diagrammatic perspective view of the present invention with parts in section and exploded, showing the arms of the double ring components being straight.

110 an easy tooless installed curtain rod for window
112 elongated tubular member of curtain rod 110
112A-112B a pair of dimples located on the middle of the elongated tubular member 112
114 hollow chamber in elongated tubular member 112
116 metal coil spring of curtain rod 110
118 a short tubular sleeve of curtain rod 110, which slides inside of the elongated tubular member 112.
120 first round metal stopper of curtain rod 110
122 second round metal stopper of curtain rod 110
124 curved handle on short tubular sleeve 118
126 non-skid rubber material end piece of first and second round metal stoppers 118,120
128 double ring component of curtain rod 110
130 decorative rod
132 large ring member of double ring component 128
134 arm of double ring component 128
136 small ring member of double ring component 128
138 first set screw for large ring member 132
140 second set screw for small ring member 136
142A-142B decorative heads
144 window
144A left sidewall of a window
144B right sidewall of the window
150 second curtain on the decorative rod 130

DETAILED DESCRIPTION OF THE PREFERRED EMBODIMENT

Figure 2:
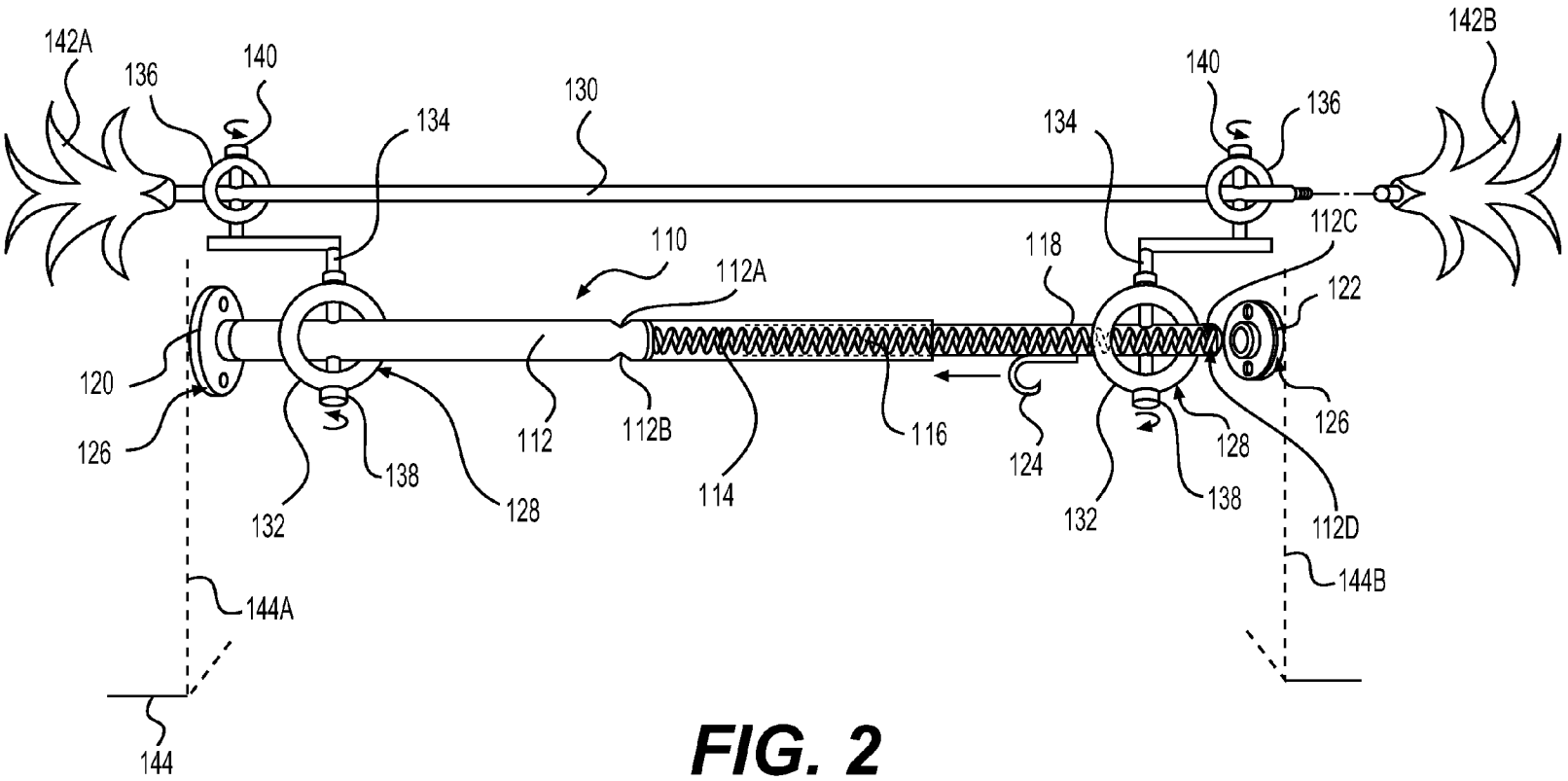
FIG. 2 is a diagrammatic perspective view of the present invention with parts in section and exploded, showing the arms of the double ring components being L-shaped.

As shown in FIGS. 1 and 2, an easy tooless installed curtain rod 110 comprises an elongated tubular member 112 having a hollow chamber 114 at an inner end and a pair of dimples 112A-112B at the middle. A metal coil spring 116 is placed within the hollow chamber 114 of the elongated tubular member 112. One end of the metal coil spring 116 is limited by the dimples 112A-112B. A short tubular sleeve 118 slides over the inner end of the elongated tubular member 112 to engage with the other end of the metal coil spring 116. The other end of the metal coil spring 116 is limited by a pair of dimples 112C-112D at one end of the short tubular sleeve 118. A pair of metal stoppers 120,122 is provided. The first stopper 120 fits onto a distal end of the elongated tubular member 112 and the second stopper 122 fits onto a distal end of the short tubular sleeve 118. Each stoppers 120 can also have optional screw holes for existing holes on the window. The tubular member 112 has a diameter in a range of 0.90-1.0 inches. The short tubular sleeve 118 has a diameter in about 0.90 inches.

A curved handle 124 (3 inches long with U-shape at the end, and 0.1 inch diameter) is affixed onto a side of the short tubular sleeve 118. When the curved handle 124 is manually pulled or twisted inwardly, the short tubular sleeve 118 will compress the coil spring 116 to provide tension and flexibility between the pair of round metal round metal stoppers 120,122 (with non-skid rubber material end pieces 126) which can be positioned to bear against opposite sidewalls 144A-144B of a window 144, so that a second curtain 150 can hang on the elongated tubular member 112 that is secured within the window 144 (note: a first curtain (not shown) should be placed on the curtain rod 110). Each stopper 120,122 is attached to non-skid rubber material end pieces 126 to prevent slippage and to produce no physical damages to the left sidewall 144A and right sidewall 144B of a window 144.

The stoppers 120,122 and end pieces 126 can have the shape: round, rectangular, or square.

Here are, the curtain rod 110 can be made to accommodate different sizes in length of different size windows: 24 in-42 in, 36 in-63 in, 50 in-87 in, 86 in-120 in.

The non-skid rubber material can be neoprene, or black vinyl.

A pair of double ring components 128 are for retaining a decorative rod 130 parallel and adjacent to the elongated tubular member 112, so as to support a second curtain extending from the decorative rod 130. Each double ring component 128 comprises a large ring member 132 to fit upon the elongated tubular member 112. An arm 134 extends from the large ring member 132. A small ring member 136 is affixed to the distal end of the arm 134, whereby the small ring member 136 will fit upon the decorative rod 130. Each of the decorative heads 142A-142B will be screwed into both ends of the rod 130.

The small ring member 136 has 0.75 or ¾ inch diameter and 0.15 inch in width. The large ring member 132 has 1.0 inch diameter and 0.15 inch in width. This arm 134 has 2.5 inch in length.

The curtain rod 110 further comprises two set screws 138,140. The first set screw 138 is threaded into the large ring member 132 to engage with the elongated tubular member 112, while the second set screw 140 is threaded into the small ring member 136 to engage with the decorative rod 130. The screws 138, 140 can be tightened by hand to keep the curtain rod 110 and decorative rod 130 in place.

As shown in FIG. 1, the arm 134 is straight between the large ring member 132 and the small ring member 136.

As shown in FIG. 2, the arm 134 is L-shaped between the large ring member 132 and the small ring member 136 to give an illusion of an oversized window. This L-shaped arm 134 has 2.0 inches in length.

The metal material of the rod 110, tubular member 114, sleeve 118, stoppers 120, 122, pair of double ring components 128 can be aluminum, stainless steel, or cast iron.

It will be understood that each of the elements described above, or two or more together, may also find a useful application in other types of constructions differing from the types described above.

While the invention has been illustrated and described as embodiments of an easy tooless installed curtain rod, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. An easy toolless installed curtain rod for window comprising:

a) an elongated tubular member (112) having a hollow chamber at an inner end and a pair of dimples at the middle of said elongated tubular member;

b) a metal coil spring placed within the hollow chamber of the elongated tubular member, wherein one end of the coil spring engages the pair of dimples;

c) a short tubular sleeve slides over the inner end of the elongated tubular member to engage with the other end of the coil spring; wherein the other end of the metal coil spring (116) is limited by a pair of dimples at one end of the short tubular sleeve (118);

d) a pair of metal stoppers, whereby the first stopper fits onto a distal end of the elongated tubular member and the second stopper fits onto a distal end of the short tubular sleeve; and e) a curved handle affixed onto a side of the short tubular sleeve, whereby when the curved handle is manually pulled or twisted inwardly, the short tubular sleeve will compress the coil spring to provide tension and flexibility between the pair of round metal stoppers which can be positioned to bear against opposite sidewalls of a window, so that a curtain can hang on the elongated tubular member that is secured within the window, and a pair of double ring components for retaining a decorative rod parallel and adjacent to the elongated tubular member, so as to support a second curtain extending from the decorative rod.

2. The curtain rod as recited in claim 1, wherein each stopper is attached to non-skid rubber material end piece to prevent slippage and to provide no physical damage to the sidewalls.

3. The curtain rod as recited in claim 1, wherein the stoppers and end pieces of the curtain rod can have a shape consisting a group selected: round, rectangular, and square.

4. The curtain rod as recited in claim 2, wherein said non-skid rubber material consisting of one of the selected group: neoprene, and black vinyl to prevent slippage and provide no physical damage to the sidewalls.

5. The curtain rod as recited in claim 1, further disclose the elongated tubular member and the short tubular sleeve can be made in different sizes: 24 in-42 in, 36 in-63in, 50 in-87 in, 86 in-120 in.

6. The curtain rod as recited in claim 1, further disclose the tubular member (112) has a diameter in a range of 0.90-1.0 inches and the short tubular sleeve (118) has a diameter in about 0.9 inches.

7. The curtain rod as recited in claim 1, wherein each said double ring component comprises:

a) a large ring member to fit upon the elongated tubular member;

b) an arm extending from the large ring member;

c) a small ring member affixed to the distal end of the arm, whereby the small ring member will fit upon the decorative rod.

8. The curtain rod as recited in claim 7, further disclose the metal material of tubular member, the short tubular sleeve, said pair of stoppers, said pair of double ring components can be selected from a group consisting of aluminum, stainless steel, or cast iron.

9. The curtain rod as recited in claim 7, further comprising two set screws, whereby the first set screw is threaded into the large ring member to engage with the elongated tubular member, while the second set screw is threaded into the small ring member to engage with the decorative rod.

10. The curtain rod as recited in claim 7, further disclose the small ring member has 0.75 inch diameter and 0.15 inch in width and the large ring member has 1.0 inch diameter and 0.15 inch in width.

11. The curtain rod as recited in claim 7, wherein the arm is straight between the large ring member and the small ring member.

12. The curtain rod as recited in claim 7, further discloses the arm has 2.5 inch in length and 0.15 inch width.

13. The curtain rod as recited in claim 7, wherein the arm is L-shaped between the large ring member and the small ring member to give an illusion of an oversized window.

14. The curtain rod as recited in claim 13, further discloses the L-shaped are has 2.0 inches in length and 0.15 inch width.

* * * * *